United States Patent [19]

Rickard

[11] 4,192,280

[45] Mar. 11, 1980

[54] COMBINATION OF AN ARCHERY BOW AND ADJUSTABLE PULLEY ASSEMBLY

[76] Inventor: Lawrence C. Rickard, 580 Mentone Rd., Lantana, Fla. 33462

[21] Appl. No.: 941,266

[22] Filed: Sep. 11, 1978

[51] Int. Cl.[2] ..... F41B 5/00

[52] U.S. Cl. ..... 124/23 R; 124/86

[58] Field of Search ..... 124/23 R, 24 R, 22, 124/90, 86, 35 A, 35 R

[56] References Cited

U.S. PATENT DOCUMENTS

| | | | |
|---|---|---|---|
| 3,967,609 | 7/1976 | Frydenlund | 124/24 R |
| 4,064,862 | 12/1977 | Groner | 124/23 R |

*Primary Examiner*—Richard C. Pinkham
*Assistant Examiner*—William R. Browne
*Attorney, Agent, or Firm*—Malin & Haley

[57] ABSTRACT

An archery bow and drawstring pulley assembly which is mounted at each end of an archery bow limb for receiving a drawstring. Each pulley assembly includes a first U-shaped housing which is connected to a bow limb, a second housing which is U-shaped and receivable between the U-shaped first housing walls. A pulley wheel is mounted on a pin disposed within the second housing. The first and second housings are hinged together, which allows the second pulley housing to be pivoted relative to the first housing. A rigid shaft is connected to the first and second housings which allows for threadably adjusting the position of the second housing with respect to the first housing. The pulley assembly allows for precise tensioning adjustment of the bow drawstring by movement of the positioning shaft to the exact desired position without experiencing any loss of bow string force.

1 Claim, 3 Drawing Figures

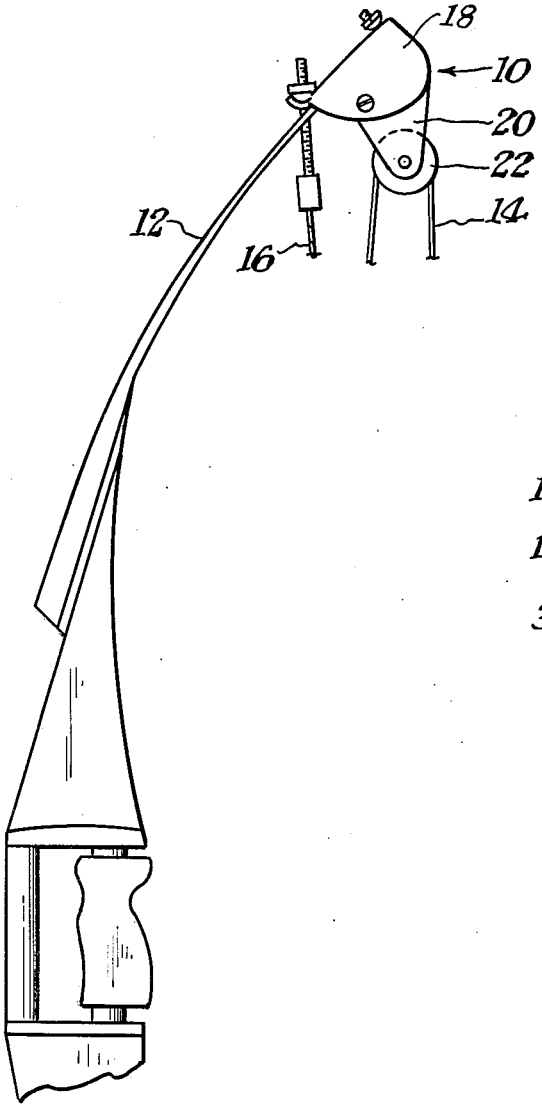
Fig. 1.
Fig. 2.
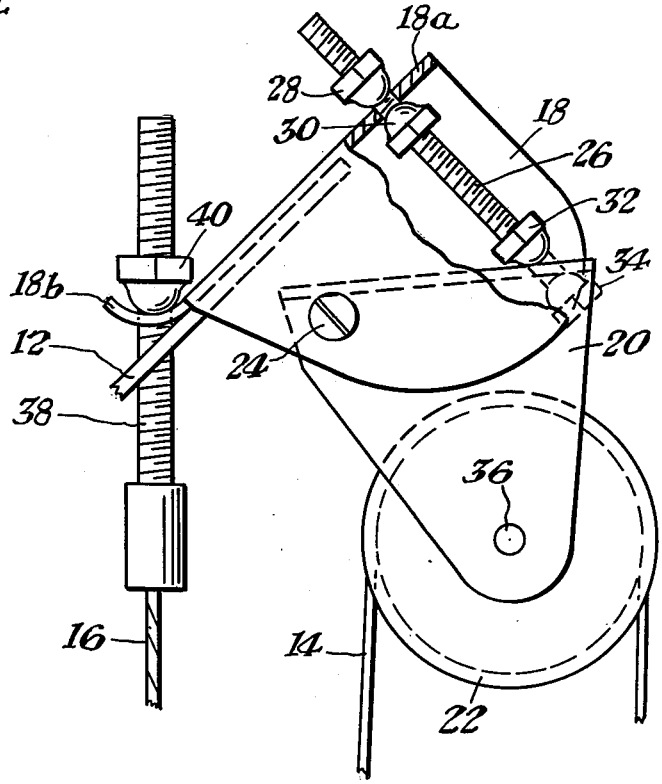
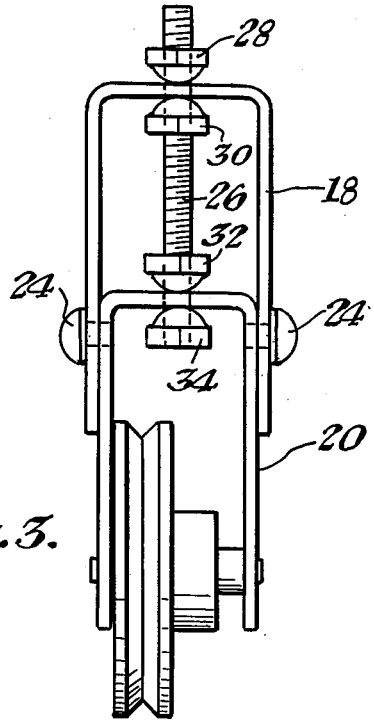
Fig. 3.

COMBINATION OF AN ARCHERY BOW AND ADJUSTABLE PULLEY ASSEMBLY

BACKGROUND OF THE INVENTION

This invention relates to an improved pulley for a bowstring used on a compound bow which allows the bowstring to be precisely tensioned with respect to the bow limb and adjusted for draw length.

Compound bows are well known in the prior art. The bows shown in the prior art have normally used a fixed pulley, one at each end of the limb, for receipt of the drawstring of the bow. One of the problems with the fixed pulley is that the bowstring must be tensioned and connected or anchored in the compound bow very tightly to achieve best performance of the bow. The present invention allows an archerer to tension the drawstring of the bow by movement of a positioning pin which allows the drawstring to be tensioned relative to the bow housing without reducing the accuracy or strength force of the bow itself.

The pulley, in accordance with the instant invention, has a pulley housing which may be pivotally adjusted relative to a housing fixed to the bow limb and rigidly secured in the desired position.

BRIEF DESCRIPTION OF THE INVENTION

An archery bow has a pulley assembly mounted at the end of each bow limb. Each pulley assembly has a first U-shaped housing which is rigidly fixed to a bow limb, a second pulley housing which is pivotally fixed to the first housing allowing pivotal relative movement between the first and second housings. The second housing has a U-shaped wall with a pulley wheel mounted therein about which a bowstring is reeved. The pulley wheel includes a central pin which allows rotational movement of the pulley wheel relative to the second housing. A rigid threaded shaft connects the first and second housings together to allow adjustable movement of the pulley wheel relative to a bow limb. A pair of threaded nuts act as stops to allow for adjustment of the second housing relative to a bow limb by threadably moving the stops to the desired position.

To operate the device, the bowstring is received around the pulley in a conventional manner. The user may then, by moving the threaded stops on the shaft, move the pulley housing either forward or backward, resulting in a tensioning of the drawstring to the desired limit.

It is an object of this invention to provide an improved bow drawstring pulley assembly.

It is another object of this invention to provide a pulley assembly for an archery bow which may be adjusted, allowing adjustment of a bow drawstring.

But yet, still another object of this invention is to provide a pulley wheel which is pivotally mounted relative to a bow frame so that the pulley wheel may be precisely positioned relative to a bow frame for adjusting the drawstring of a bow.

In accordance with these and other objects which will be apparent hereinafter, the instant invention will now be described with particular reference to the accompanying drawings.

BRIEF DESCRIPTION OF THE DRAWINGS

FIG. 1 shows a fragmentary view of a bow frame with applicant's improved pulley mounted at one end thereupon.

FIG. 2 shows a side elevational view of the instant invention partially in cross-section.

FIG. 3 shows a back elevational view of the instant invention.

PREFERRED EMBODIMENT OF THE INVENTION

Referring now to the drawings, and specifically FIG. 1, the instant invention is shown generally at 10 affixed to the upper limb of a bow frame 12. The compound bow includes a drawstring 14 fragmentarily shown and a second bowstring 16 anchored to the limb 12. The instant invention includes a first U-shaped housing 18 which is affixed to the bow limb 12 and a second housing 20 upon which pulley wheel 22 is mounted.

Referring now to FIG. 2, the instant invention is shown mounted on bow frame 12 and including a first U-shaped plate 18 in which the bottom plate **18*a* is received on one side of bow frame 12. The side walls of housing 18 receive therebetween a second U-shaped housing 20 and are mounted by a pair of hinge pins 24 which allow for pivotal movement between second housing 20 and first housing 18. The second housing 20 is U-shaped and has a pulley wheel 22 rotatably mounted therein by pin 36. The second housing 20 upon which the pulley wheel 22 is mounted may be rigidly but adjustably positioned relative to first housing 18 by a threaded connector including a shaft 26 having threads disposed thereupon and a pair of adjusting nuts 28 and 30 and 32 and 34. Nuts 28 and 30 are mounted on each side of the end base wall 18*a* of housing 18 while nuts 32 and 34 are mounted on each side of the end base wall of housing 20. Each of the nuts, which is rotatably movable relative to shaft 26, can be positioned to fix the relative position of housing 20 to housing 18. This allows for movement of the pulley wheel 22 relative to the bow limb 12 such that the pulley may be rigidly fixed at a desired position allowing one to properly tension the bowstring 14. In one embodiment, a secondary bowstring 16 is anchored to the limb 12 by threadable shaft 38 and includes an adjustable nut which rests against an end flange 18*b* forming a part of the first housing 18. This anchors housing 18 firmly to the bow limb 12 while allowing for adjustment of the second bowstring 16**, useful in a compound bow.

FIG. 3 shows the pins 24, which allow for pivotal movement between the first housing 18 and the pulley housing 20. Movement of the pairs of nuts 28 and 30 and 32 and 34 longitudinally along shaft 26 will rigidly allow for arriving at a fixed position of the pulley relative to the bow limb. The pulley wheel 22 and consequently the string mounted thereto has its alignment in a plane that is disposed through the central portion of the bow frame itself.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A combination of an archery bow with bow limbs and bow string, said combination further comprising a pulley assembly including a first U-shaped housing connected to one of said bow limbs;

a second U-shaped housing pivotally mounted to said first housing, said second housing including a rotatably coupled pulley wheel for receiving said bowstring; and a manual means for variably positioning said second pulley housing relative to said first housing.

* * * * *